US005197691A

United States Patent [19]

Amon et al.

[11] Patent Number: 5,197,691

[45] Date of Patent: Mar. 30, 1993

[54] BORESIGHT MODULE

[75] Inventors: Max Amon, Maitland, Fla.; Nicholas B. Saccketti, Tucson, Ariz.

[73] Assignee: Martin Marietta Corporation, Bethesda, Md.

[21] Appl. No.: 532,885

[22] Filed: Sep. 16, 1983

[51] Int. Cl.[5] ..... F41G 7/24; F41G 3/06; G01B 11/26

[52] U.S. Cl. ..... 244/3.13; 89/41.06; 89/41.19; 356/152

[58] Field of Search ..... 244/3.13; 356/5, 152; 89/41.06, 41.19

[56] References Cited

U.S. PATENT DOCUMENTS

| | | | |
|---|---|---|---|
| 3,628,868 | 12/1971 | Starkey | 356/152 |
| 3,752,587 | 8/1973 | Myers et al. | 356/152 |
| 4,155,096 | 5/1979 | Thomas et al. | 244/3.13 |
| 4,299,360 | 11/1981 | Layton | 244/3.13 |
| 4,561,775 | 12/1985 | Patrick et al. | 356/152 |

*Primary Examiner*—Charles T. Jordan
*Attorney, Agent, or Firm*—Julian C. Renfro; Gay Chin; Michael L. Slonecker

[57] ABSTRACT

An optical arrangement for use in boresighting a plurality of optical paths utilized in a missile beam guidance system, to the target trackers used therewith. A boresight module optical bed supports a plurality of retro-reflective optical assemblies in a closely spaced array, and nearby is a rotational optical assembly in which is mounted an integrated laser system for providing beam guidance to a missile. The rotational optical assembly also contains a plurality of target trackers, and in a first operational mode, the laser of the rotational assembly is successively utilized in conjunction with the retro-reflective optical assemblies in order to accurately and conveniently boresight the trackers. Thereafter, the trackers are used in the acquisition and tracking of a target, and the laser is utilized for guiding the missile to intercept the target.

13 Claims, 8 Drawing Sheets

BORESIGHT MODULE

RELATIONSHIP TO OTHER INVENTION

This invention may be regarded as closely related to the co-pending patent application of Max Amon and AndréMasson entitled "Command Optics", Ser. No. 571,581 filed Jan. 17, 1984.

BACKGROUND OF THE INVENTION

Automatic television tracker systems including television point trackers or area correlation trackers operating with compatible sensors such as vidicons have been found capable of meeting the requirement for system pointing accuracies on the order of tenths of a milliradian. The tracker measures any alignment error between the line of sight to the target and the optical system pointing vector and issues error signals which command the system servos to correct the system pointing vector to achieve the desired result.

For a truly effective fire control system, the laser beam to be directed at the distant target must be boresighted to the television and/or FLIR tracker systems. Prior boresighting systems include those which sight the laser designator when separated from the launcher (ground, sea or air based), such as during initial assembly only, or at scheduled intervals in a maintenance shop. Other systems permit boresighting while the laser pod is installed on the launching vehicle. However, these prior art systems are limited to occasional boresighting on laser secure ranges or to flight line boresighting to each mission of an aircraft. The system which would allow for the smallest boresight error over many missions is the type which is based upon airborne boresighting. Airborne boresighting techniques may involve the alignment of the laser optical axis only at the beginning of the mission in response to a pilot initiated command, or boresighting may be initiated each time the fire control system is activated.

Examples of known boresighting techniques are given in U.S. Pat. No. 3,628,868 issued Dec. 21, 1971 to Starkey and U.S. Pat. No. 3,752,587 issued Aug. 14, 1973 to Meyers et al. Starkey shows a laser boresight device which has a telescope mounted on the housing of the laser and accomplishes boresighting through manual micrometer adjustments. Meyers discloses a boresighting device which utilizes a strip of material to which the laser is directed during the boresighting operation. The laser burns a hole through the strip allowing light to pass through to the television sensor. The image thus created is aligned on the television camera through the manual adjustment of the horizontal and vertical potentiometers, which center the image with respect to optical crosshairs. Neither of these references disclose automatic boresighting, and this fact is quite significant when it is realized that a pilot, for example, is preoccupied with aircraft flight tasks, and in such circumstances cannot perform manual laser boresighting accurately and reliably.

U.S. Pat. No. 4,155,096 issued May 15, 1979 to Thomas et al taught automatic laser boresighting. These patentees achieved boresighting the laser of a laser designator system to the null point of an automatic television tracker, by selectively causing the laser beam to be retroreflected to the video sensor of the system, which interfaces with a television tracker. The tracker locks onto the retroreflected laser spot, with the tracker error signals being used in a feedback control loop to control the video sensor raster bias. The raster bias voltages center the video sweeps about the laser spot, thereby nulling the tracker error signals and achieving boresight with the laser automatically.

It is well known that certain missiles are designed to h=launched from a land-based, water-based or flight vehicle, and then guided to a selected target by means of optical guidance, radar guidance or the like. One such system of interest to this invention involves a land-based vehicle having a number of launch tubes for rocket powered missiles, which missiles are guided to their target by means of a beamrider guidance system.

The means for tracking a ground to air missile may, for example, utilize TV as well as FLIR (Forward Looking Infra Red) sensors mounted on the launch vehicle to enable the target, for instance an aircraft, to be tracked in daylight as well as during times of poor visibility. On such a vehicle are not only these components, but also a plurality of zoom optic systems, such that the missile may be accurately tracked by a first optical subsystem, and then concentrated guidance information sent to the missile by a second optical subsystem during the rocket motor burn phase, when the plume from the motor is difficult to penetrate. Then, terminal guidance is provided by a third optical subsystem during the unpowered or coast phase of the missile, when precise guidance commands to the missile are extremely important if the target is to be intercepted.

As explained at length in the Amon and Masson invention cited above, a Zoom Projection Optic (ZPO) device provides an electromagnetic radiation beam guidance system which spatially encodes a guidance beam cross-section to develop a large number of resolution elements Each resolution element is uniquely designated by a digital code effected by frequency modulating the radiation in each resolution element according to a different digital word. In other words, a "guidance corridor" is created, enabling the missile to continuously derive up/down and left/right signals and bring about a correction of the flight path of the missile to the central resolution element of the matrix of elements. The ZPO optical device, through which laser energy is directed, is employed for the terminal guidance of the missile.

The ZPO device is preferably utilized in conjunction with a pair of counter-rotating reticle wheels, that are used to spatially encode the guidance beam cross section to develop a large plurality of resolution elements used in terminally guiding the missile. More details of such reticle wheels are to be found in the U.S. Patent to Allen C. Layton, U.S. Pat. No. 4,299,360, issued Nov. 10, 1981. During boresighting, these reticle wheels are disposed in a preestablished stationary position in order to define a highly accurate line of sight. This optical path is utilized to align the other optical components of the system, to permit proper boresighting.

It was as a result of efforts to achieve boresight on a rapid and highly accurate basis that the present invention was developed.

SUMMARY OF THIS INVENTION

In accordance with this invention, we have evolved a boresighting arrangement readily adaptable for incorporation into a turret of the type that may readily be carried on a vehicle, such as a land-based vehicle or a water-based vehicle. Such turret includes a first mounting means for supporting a plurality of retro-reflective optical assemblies in a closely spaced array, and a second mounting means that has rotational capability in elevation, as well as being slewable in azimuth. Mounted in the second mounting means or rotational optical assembly are Zoom Projection Optics (ZPO), a TV tracker, a Forward Looking Infra Red (FLIR) device, and Command Optics. The Command Optics involve a Missile Tracker Zoom (MTZ), and the Temporal Mode Laser Optics (TMLO), as well as a laser utilized in conjunction with such components As described at length in the previously-cited copending application of Amon and Masson, the Command Optics is designed to track and guide the beamrider missile during the burn period of the rocket motor of the missile, when use of the ZPO may not be as effective.

The rotational optical assembly or second mounting means is generally cylindrical in shape, with the principal axis of the cylinder being generally horizontally disposed. Because of its configuration, we often refer to the rotational optical assembly as an "ashcan". It is about such horizontal axis that the ashcan or second mounting means can be rotated to accommodate changes in elevation, with the entire optical assembly being rotatable about a vertical axis through a pedestal mounted on the turret of the vehicle when desired to move the optical components in azimuth.

The primary optical axis insofar as boresighting is concerned is the ZPO axis, along which azimuth and elevation information developed by the use of a laser interacting with the counter-rotating reticle wheels is sent to the missile being guided to the target. In other words, a primary guidance corridor is thus defined, along which the coasting missile is guided to impact with the target We regard the laser operating in concert with the ZPO and the crossed slits of the reticle wheels (created when the wheels are disposed in a preestablished stationary position) as defining an integrated laser system. We could of course modulate the laser output to provide guidance information to the missile during all phases of flight, but during the phase of flight after motor burnout when the ZPO is being utilized, we prefer the use of the rotating reticle wheels, because such use makes the generation of very accurate position information possible.

Generally, the respective output windows of the FLIR, TV and other components are arrayed approximately the same distance from the rotational axes, so that when the rotational assembly is moved in elevation or azimuth, the several windows move in like amounts. Because of the necessity of boresighting the TV, FLIR, and the Command Optics (including the MTZ and TMLO) to the ZPO, for example daily, it is desirable to utilize fixed optical components, known as retro-reflector assemblies or prism assemblies, that should be readily available for boresighting on an as-needed basis. Rather than having an ancillary vehicle carry the alignment assemblies or prisms, or having to set them up each time boresighting is necessary, we instead dedicate a portion of the turret adjacent the rotational optical assembly for the mounting of the retro-reflector assemblies. These assemblies are mounted on what we regard as the boresight module optical bed, otherwise known as the first mounting means. Then, when boresighting is necessary, it is only necessary to rotate the ashcan or second mounting means about its horizontal axis, up and around to a generally rearward position, such that it faces the portion of the turret containing the boresight assemblies, thus to enable a rapid boresight operation.

In the interest of creating retro-reflector assemblies that are of reasonable price, we utilize separate boresight assemblies arrayed in a closely spaced relationship to each other. After being rotated to the rearwardly directed, boresight position, the ashcan may be slewed successively as necessary in boresighting three optical paths. The ashcan is slewed to somewhat different positions in achieving alignment with the first and the second retro-reflector assemblies, and then slewed to a still different position for achieving alignment with the third retro-reflector assembly. These successive boresighting steps are accomplished rapidly, yet in a highly accurate manner.

It is a primary object of our invention to provide a ready boresight capability for any 3μm to 5μm missile tracking system in which a $CO_2$ laser is principally utilized.

It is another important object of our invention to provide a novel assembly of optical boresight devices adjacent a rotational optical assembly containing a plurality of optical trackers, such that boresighting of the trackers to the laser guidance system may be readily and conveniently achieved.

It is still another important object of this invention to provide means in our novel boresight assembly whereby a wavelength conversion may be effected to enable rapid boresighting of optical sensors operating in different parts of the optical spectrum.

It is yet another object of our invention to make available in an arrangement utilizing spinning reticle wheels providing guidance information to a missile, a boresighting arrangement when utilized in conjunction with such reticle wheels disposed in preestablished, stationary positions, such that various optical sensors can be boresighted to a highly accurate line of sight.

It is yet still another object of our invention to provide a novel method for boresighting a plurality of optical paths utilized in a missile beam guidance system, to the target trackers used therewith.

These and other objects, features and advantages of this invention will be more apparent as the description proceeds.

DETAILED DESCRIPTION

Figure 1:
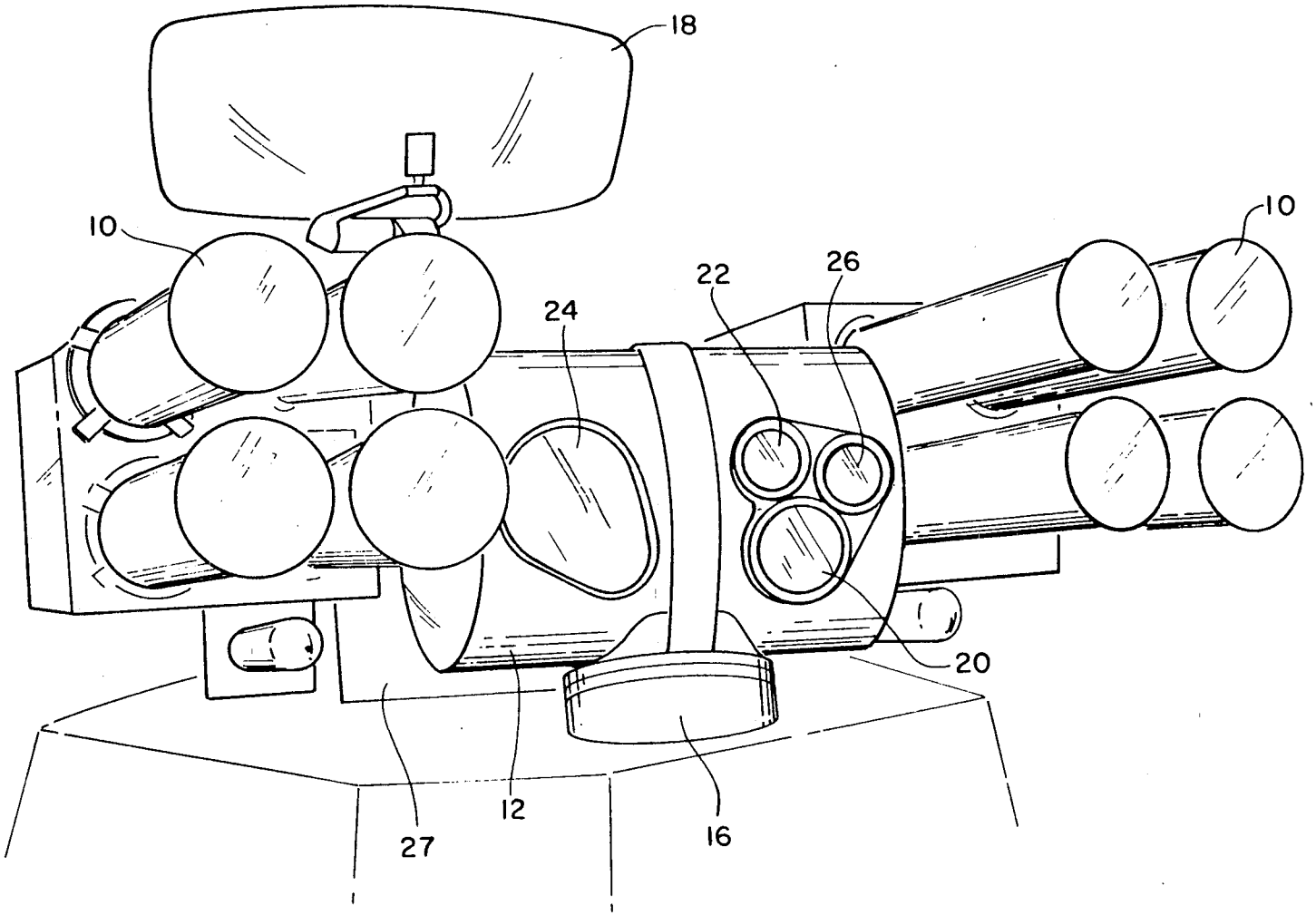
FIG. 1 is a perspective view of a typical rotational optical assembly or ashcan utilized on the turret of a vehicle, in which assembly are contained the components utilized in guiding surface-to-air or surface-to-surface missiles to their respective targets.

Turning first to FIG. 1, it will there be seen that we have depicted the turret portion of a vehicle equipped with a plurality of tubes 10 for the launch of missiles, such as surface-to-air missiles or surface-to-surface missiles. Mounted between the two banks of tubes is a rotational optical assembly 12, with which the principal part of this invention is utilized.

The rotational optical assembly 12 is generally of cylindrical shape, and disposed with its principal axis in a generally horizontal plane, and because of its appearance, it is often referred to as the "ashcan". The ashcan is rotatable about its horizontal axis so that it can readily change its elevation angle, and it is slewable about its pedestal 16 as well. A radar dish 18 may also be used on the turret of the vehicle, but it bears no direct relationship to the instant invention.

Disposed on the front of the ashcan 12 is a plurality of windows or apertures. A first of these we call the ZPO window 20, since it relates to the Zoom Projection Optics utilized for forming the principal optical path along which each missile is guided. Also depicted is a window 22 utilized in conjunction with a TV, which is readily able to recognize the contrast of a target with respect to background. Further, we use a FLIR window 24, the latter relating to a "Forward Looking Infra Red" device employed in the turret for tracking the target, such as an aircraft, tank, or other hot target. Additionally utilized is the Command Optics window 26. As previously mentioned, and as will be explained at greater length hereinafter, we use the term "Command Optics" to cover our novel Temporal Mode Laser Optics (TMLO) and our novel Missile Tracker Zoom (MTZ) devices which are combined essentially into a single package.

The TMLO, MTZ and ZPO devices are each described at length in the co-pending patent application of Max Amon and AndréMasson, cited hereinbefore, and inasmuch as it represents a detailed teaching of the Command Optics, it is believed unnecessary in this instance to describe these components at length. It is to be clearly understood that all of the pertinent teachings of that patent application are hereby incorporated by reference into the instant application.

A substantial amount of interfering infrared radiation is generated by the missile motor at the time of launching, so we typically reserve the use of the ZPO optics for terminal guidance, and utilize the Command Optics for sending and receiving positional information during the early period of missile flight, while the rocket motor of the missile continues to burn, for at such time a concentrated beam for penetrating the motor plume is necessary. The Missile Tracker Zoom (MTZ) part of the Command Optics serves to track the position of the missile at all times during powered flight, whereas the TMLO provides positional information to the missile during the motor burn period, for it provides a very concentrated beam that is able to penetrate the motor plume.

As should be obvious, it is very important that the various components and devices of the ashcan—the FLIR, the TV, the Command Optics and the Zoom Projection Optics—be boresighted so that these components can effectively and accurately interface and cooperate together. To this end we have provided in accordance with this invention, an arrangement such that these devices and components can be readily and accurately boresighted, without necessitating the bringing up of additional equipment of any kind.

Figure 2:
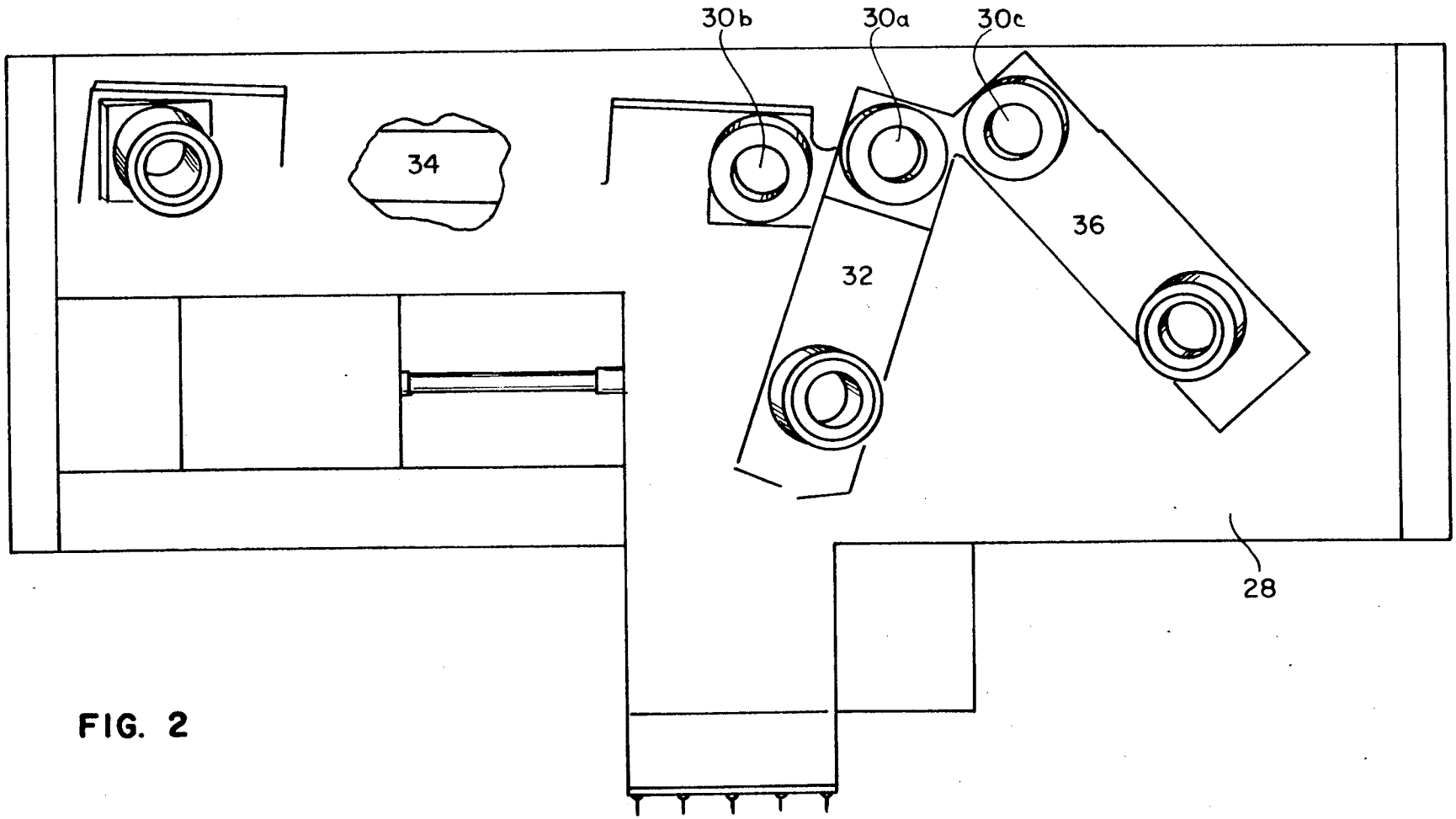
FIG. 2 is a side elevational view of the boresight module optical bed, upon which are located the several retro-reflector assemblies used in the boresighting of the several missile guidance and tracking systems contained in the ashcan portion of the turret shown in FIG. 1.

Mounted on the vehicle generally behind the rotatable optical assembly or ashcan is a support panel 27, a corner of which is shown in FIG. 1. The panel 27 serves as the support for certain electronic systems as well as supporting a boresight module optical bed 28, the front and back sides of which optical bed are shown in detail in FIGS. 2 and 3, respectively. The boresight optical bed utilizes several retro-reflectors employed in accordance with this invention, and it is also herein referred to as a first mounting means. The appearance of the optical bed 28 as seen from the ashcan 12, when directed rearwardly, is depicted in FIG. 2, whereas FIG. 3, in revealing the rear side of the boresight module optical bed 28, shows many of the actual components of the individual retro-reflector assemblies. In this context, we refer to the ashcan or rotational optical assembly as the second mounting means. Although we are not to be limited to any one constructional arrangement insofar as component details of the retro-reflector assemblies are concerned, we prefer to utilize tubes of invar, typically two inches in diameter, in which are mounted the particular optical components constituting each of the retro-reflectors.

We regard the Zoom Projection Optics, including the reticle wheels used at the ZPO focal plane in conjunction with the illuminating laser, as defining the basic line of sight (LOS) to the target, so the several apertures of the retro-reflector assemblies are each represented in an optical relationship to the ZPO apertures in FIG. 2, where they are grouped in the central portion of the boresight module optical bed 28. The aperture 30*a* in FIG. 2 is associated with the boresight retroreflector 32 used for boresighting the TV tracker to the ZPO; the aperture 30*b* is associated with the retro-reflector 34 used for boresighting the FLIR tracker to the ZPO; and the aperture 30*c* is associated with the retro-reflector 36 used for boresighting the Command Optics to the ZPO.

The laser utilized in the ashcan or second mounting means for providing beam guidance for the missiles may be a $CO_2$ laser, and this laser is employed during the boresight procedure for successively directing laser energy into each of the boresight retro-reflector assemblies. More specifically, during boresighting using the ZPO-TV retro-reflector assembly, laser energy is directed into the aperture 30*a*; during boresighting the ZPO-FLIR retro-reflector assembly, such energy is directed into the aperture 30*b*; and during boresighting using the Command Optics retro-reflector assembly, such energy is directed into aperture 30*c*. We regard the laser operating in concert with the ZPO, at which time the reticle wheels are stationary with their slits crossed, as defining an integrated laser system. The positioning of the reticle wheels during the boresight procedure will be discussed in conjunction with FIGS. 6*a* and 6*b*.

Figure 3:
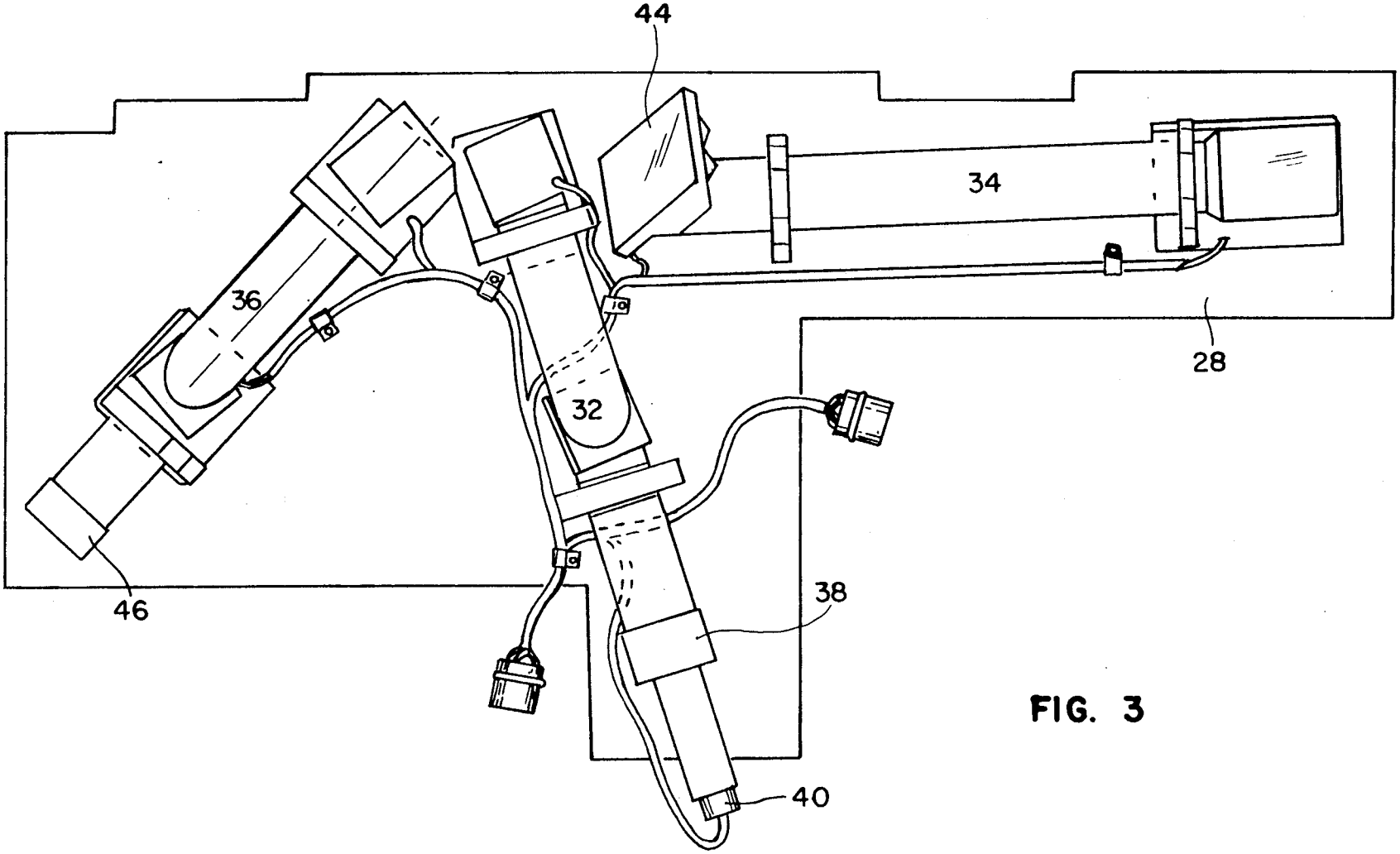
FIG. 3 is a side elevational view of the backside of the optical bed of FIG. 2, in which the construction and location of three retro-reflector assemblies utilized in accordance with this invention is shown in some detail.

In FIG. 3 we have illustrated the exteriors of the boresight retro-reflector assemblies, and visible in this Figure are certain significant components. The housing 38 for parabolic mirror 68 associated with the TV retro-reflector assembly 32 is to be seen, as is the electric wire 40 associated with the incandescent lamp or bulb (not shown) mounted in the parabolic reflector, this bulb being utilized for a reason to be discussed hereinafter. Also visible in FIG. 3 is the housing 44 for the roof mirror 48 used in the FLIR-ZPO assembly 34, and the housing 46 of the parabolic mirror 82 used in the ZPO-Command Optics assembly 36.

Figure 4:
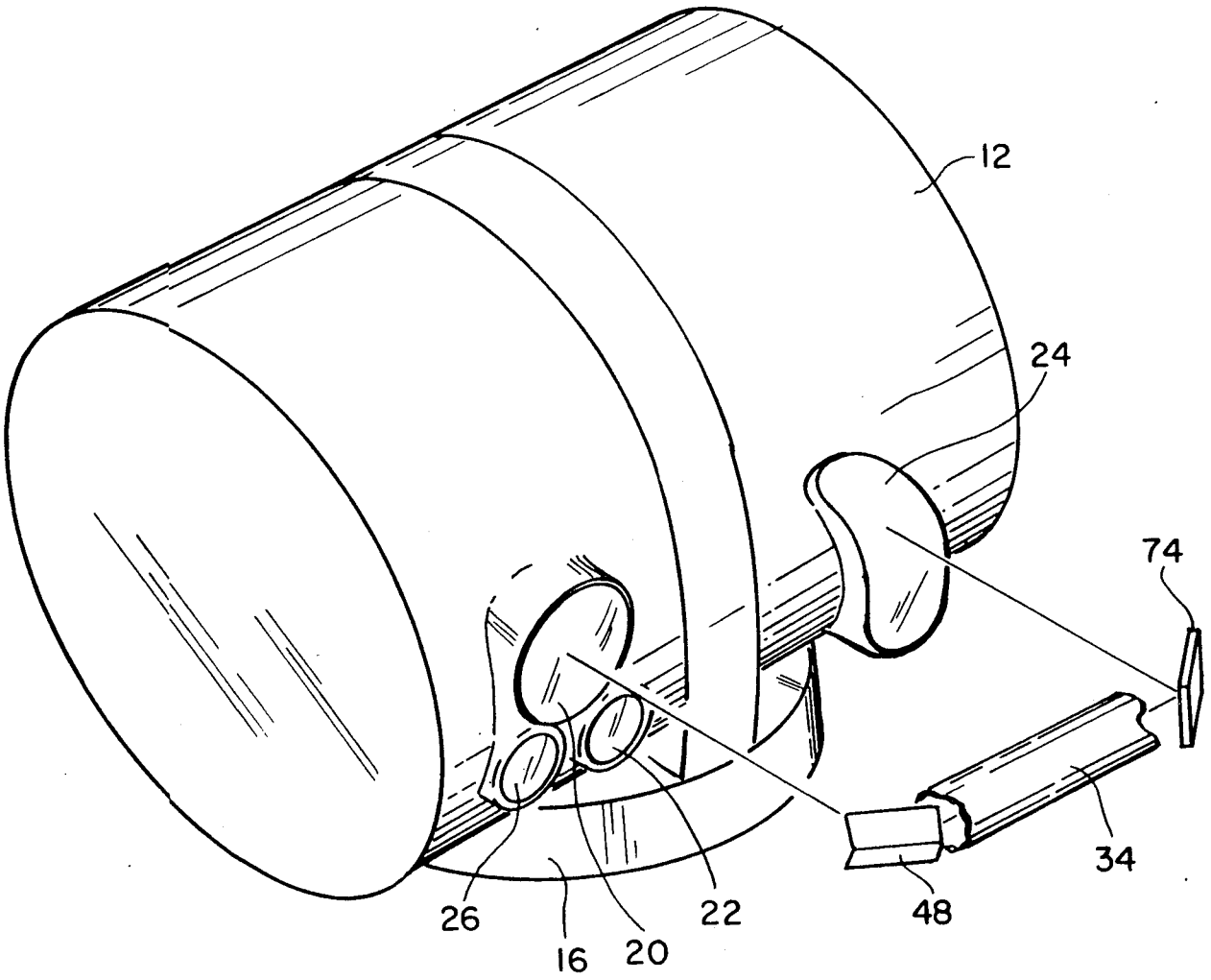
FIG. 4 is a perspective view in which the rotatable optical assembly or ashcan has been rolled approximately 180° from the position illustrated in FIG. 1, with the ashcan in this new position shown in a typical boresight interaction with one of the retro-reflector assemblies, this being the ZPO-FLIR retro-reflector assembly.

When the ashcan is to be operated in its boresighting mode, it is rotated upwardly about its horizontal axis until such time as it becomes rearwardly directed. FIG. 4 reveals the rotatable optical assembly or ashcan in its rearwardly directed, boresighting mode, where in this instance it is interacting with the ZPO-FLIR retro-reflector assembly 34. As will be noted from this Figure, the near end of this retro-reflector utilizes a so-called roof mirror 48, the inner surfaces of which are at a 90° angle and silvered. The reflector on the far end of this assembly is a planar mirror 74.

Figure 5A:
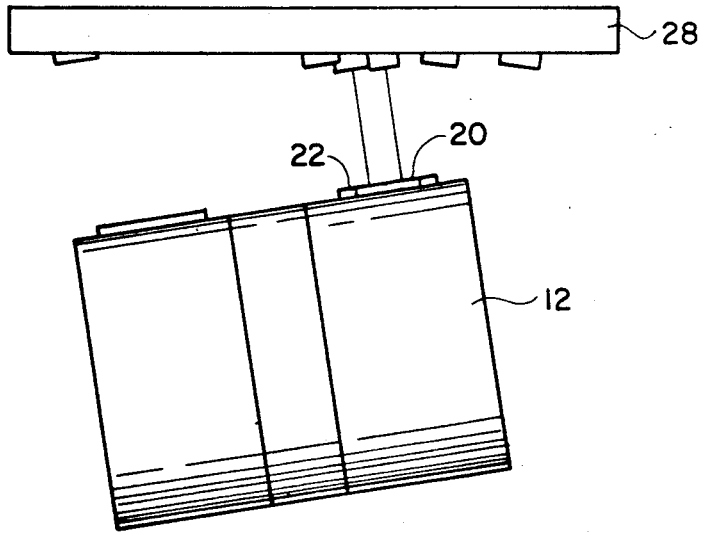
FIGS. 5*a* through 5*c* represent a schematic showing from above, of the rotational optical assembly successively interacting with the ZPO-TV, the ZPO-FLIR, and the ZPO-Command Optic retro-reflector assemblies.
Figure 5B:
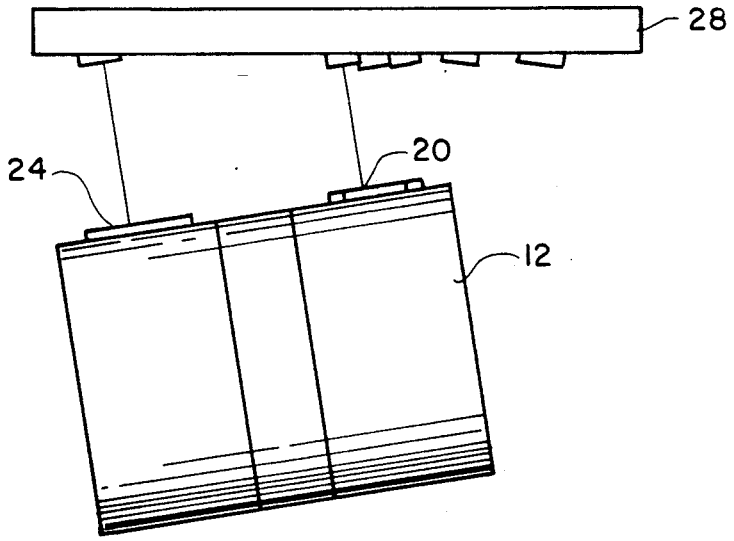
Figure 5C:
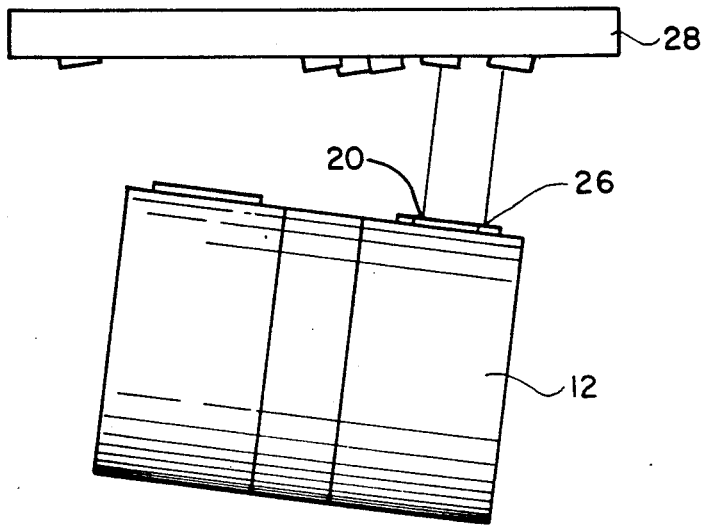

Now turning to FIGS. 5*a* through 5*c*, it will be seen that we have here depicted in a schematic fashion, the ashcan or rotational optical assembly used in its first operational mode, in which it is utilized successively in the positions where the ZPO-TV boresighting; the ZPO-FLIR boresighting; and the ZPO-Command Optics boresighting can each be accomplished.

Figure 6A:
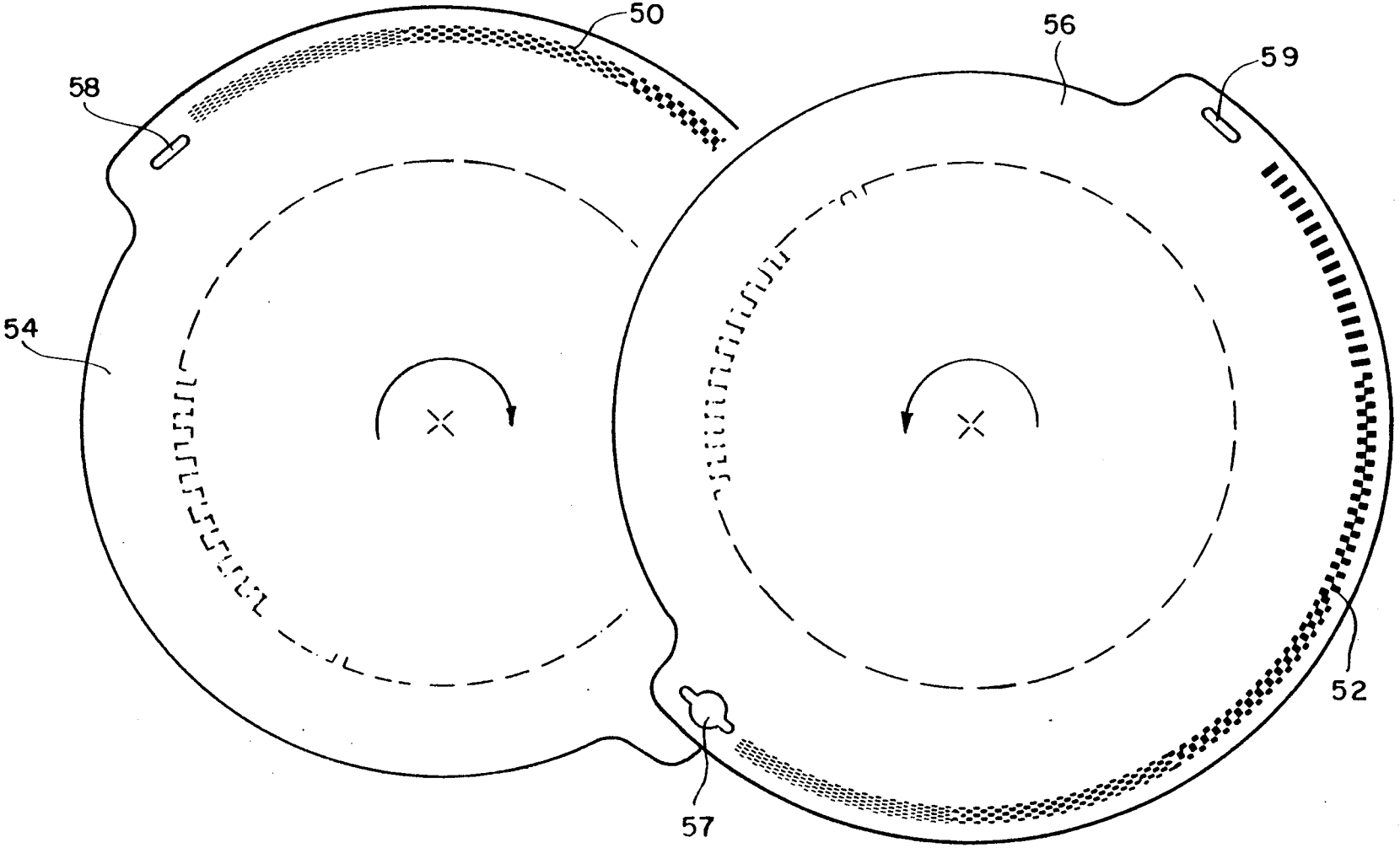
FIG. 6*a* is a side elevational view of the pair of reticle wheels utilized at the focal plane of the Zoom Projection Optics.
Figure 6B:
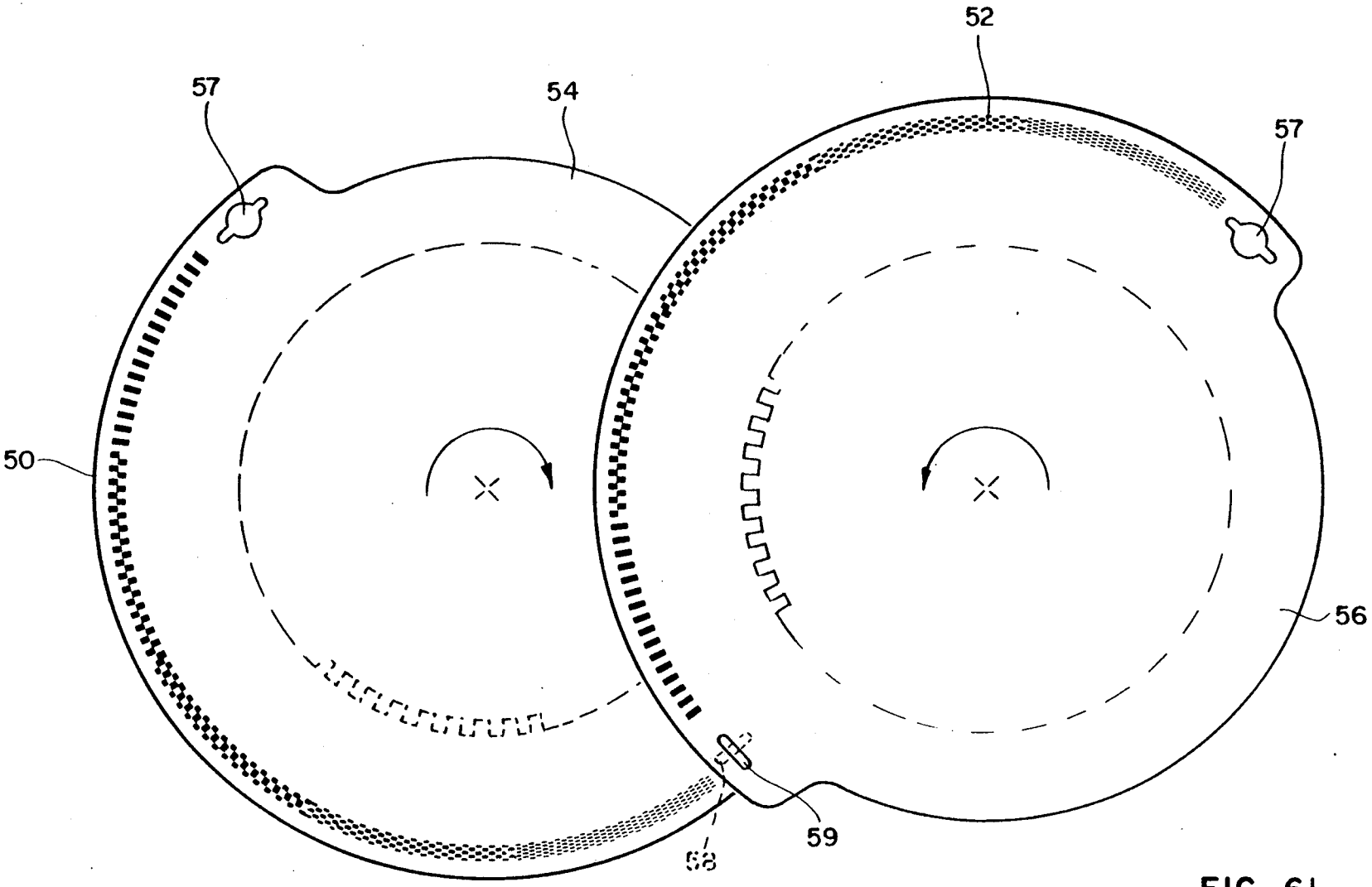
FIG. 6*b* is a side elevational view similar to FIG. 6*a*, in which the reticle wheels have been rotated to the boresight positions.

Turning to FIGS. 6*a* and 6*b*, we have there illustrated a pair of reticle wheels 54 and 56 of the type which, as explained at some length in the previously referenced patent application of Amon and Masson, are utilized at the focal plane of the Zoom Projection Optics. These wheels are made of stainless steel in order that they will be able to withstand the substantial heating effect brought about by the use of the laser for illumination.

As explained in the Layton U.S. Pat. No. 4,299,360, the reticle wheels contain certain information that is projected to the missile to communicate accurate positional information. More specifically, by the placement of certain coded slots on outer portions of the reticle wheels, the laser beam is chopped in such a way as to provide precise positional information to the missile being guided toward target impact. We prefer for the chopped beam to create a 16 by 16 cell matrix, with each cell being say ¾ meter on a side. The Zoom Projection Optics thus serve to create a cell matrix of a constant 12 meter by 12 meter size0 during missile flight subsequent to motor burnout, accomplished using zoom capability. By virtue of two aft-looking receivers utilized on the missile being guided to the target, the guidance system of the missile is able to decode the projected pattern, and as a result, to cause the missile to move toward the central cell of the matrix. Only when the missile traveling along the center of the projected laser corridor will it not be receiving signals requiring it to move up or down, or right or left. A related invention by Max Amon and Clifford Luty entitled "TIR Window", filed May 21, 1984.

Ser. No. 612,194, deals with significant portions of the windows of the missile receiver.

The encoder wheel assembly is principally comprised of a vertical resolution encoder wheel segment 50, and a horizontal encoder wheel segment 52; see FIGS. 6*a* and 6*b*. Each encoder wheel 54 and 56 is suitably connected to a respective drive gear (not shown). The vertical drive gear and the horizontal drive gear are in mesh, and driven in the desired counter-rotating relationship, preferably by a single motor. To this end, the motor (not shown) drivingly engages one of the drive gears. The encoder segments 50 and 52 each occupy less than 180 degrees. In this way they may be made to rotate, preferably one at a time, through the laser beam, there being no overlapping of the segments 50 and 52 in the area of the beam. Rotation in this instance may be in the direction of the arrows appearing on wheel members 54 and 56 in FIG. 6*a*.

In order to simplify initial alignment of the laser, we provide a comparatively large, generally circular aperture 57 near the periphery of each of the reticle wheels, as best seen in FIG. 6*b*. Then, when the wheels are at rest in the position illustrated in FIG. 6*a*, the laser beam can easily pass uninterruptedly through these aligned, circular apertures.

Although the disks are counter-rotating at a uniform rate during the transmission of the guidance information to the missile, they must be stationary during the boresighting procedure. A short circumferential slot is cut in each disc for boresighting purposes, these being slot 58 in wheel 54, and slot 59 in wheel 56, as best seen in FIG. 6*a*. Thus, when the disks are stopped in the position shown in FIG. 6*b*, boresighting can be readily accomplished. The crossed slots (or slits) combined with the ZPO forms the most basic definition of our Line of Sight (LOS) to the target.

Figure 7A:
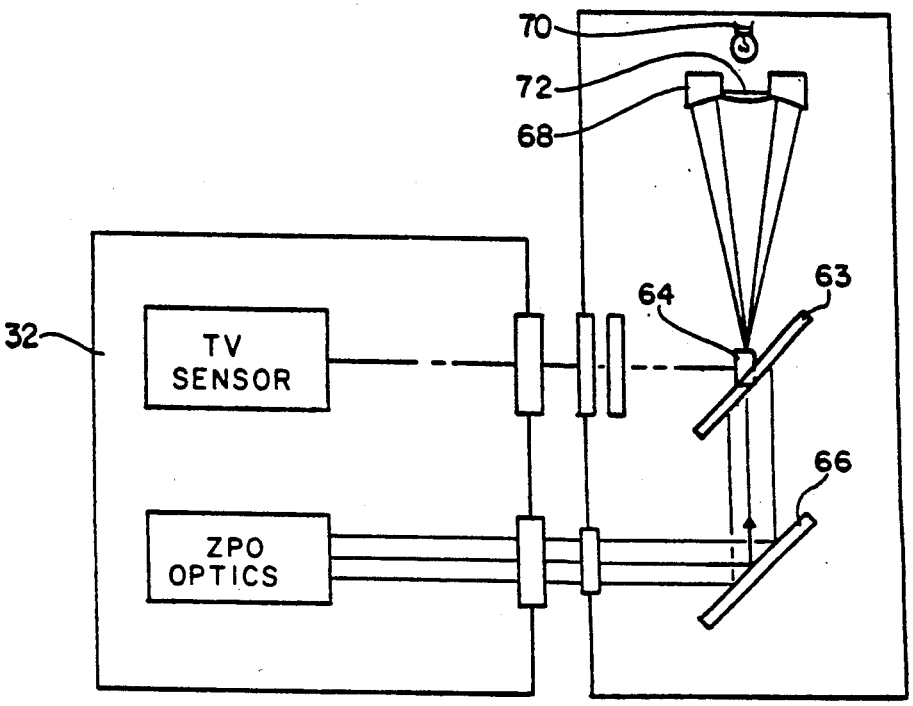
FIGS. 7*a* through 7*c* are somewhat idealized views of the retro-reflector assemblies enabling the TV, FLIR, and Command Optics devices to be boresighted to the ZPO, with important wavelength conversions being utilized in certain of these assemblies.

Turning now to FIG. 7*a*, we have shown in a somewhat simplified fashion how the TV is boresighted to the Zoom Projection Optics. It is important to note that a wavelength conversion must be accomplished to permit the TV to see the energy from the laser during the boresighting procedure. To that end we utilize a dichroic beamsplitter 63, in the center of which is disposed a target coated with a liquid crystal layer 64. Thus, laser energy passing through the ZPO optics is reflected by mirror 66 so as to pass through dichroic 63, which is transparent to 10.6 μm energy. This energy then strikes parabolic reflector 68, which is so configured and so placed as to focus the laser energy onto the liquid crystal target 64. The heat produced by absorption causes the liquid crystal to react, forming a dark spot. By virtue of a bulb 70, which directs light through a lens 72 centrally disposed in the parabolic reflector 68, a bright background is provided to enable the TV sensor to readily see the dark spot caused on the crystal layer.

A thermoelectric cooler (not shown) is utilized to control the liquid crystal target temperature, thus insuring required liquid crystal sensitivity.

Once the TV senses the dark spot, the video raster must be moved to make the TV reticle coincident with the dark spot of the liquid crystal target. When this has been done, the TV is aligned with the ZPO line of sight.

A somewhat similar operation is now used in order to align the FLIR with the Zoom Projection Optics. It should h=noted that no wavelength conversion is necessary at this time, for the FLIR tracker is sensitive to the 10.6 μm energy emanating from the laser.

Figure 7B:
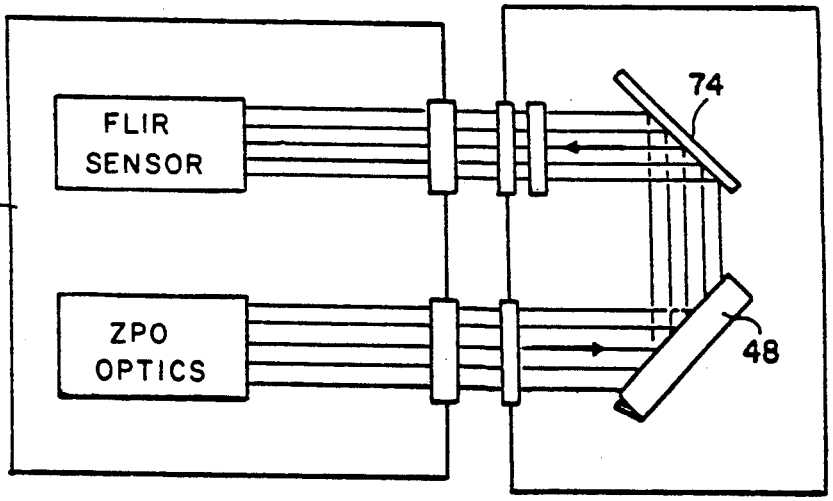
Figure 7C:
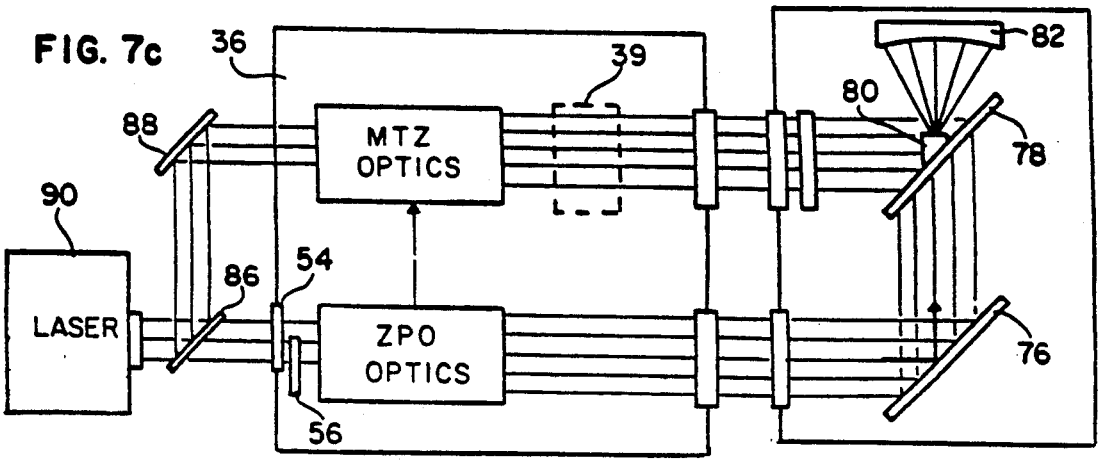

As shown in FIG. 7*b*, we prefer to utilize a retro reflector containing the previously mentioned roof mirror 48, whose silvered inner surfaces include a right angle between them. The laser energy leaving the ZPO optics is initially reflected by the roof mirror, and is then reflected by a plane mirror 74 into the sensor of the FLIR. The FLIR tracker now tracks the infrared image of the cross slits, and boresights the FLIR by shifting the raster electronically.

Lastly with regard to FIGS. *7a–7c*, in FIG. *7c* it is to be realized that we need to achieve boresight of both the MTZ and the TMLO. In this Figure we have schematically depicted the laser 90, typically a $CO_2$ laser, directing its energy through the crossed slots of the reticle wheels 54 and 56. (In this instance the mirror 86 does not reside in the position depicted in FIG. *7c*, having been switched to one side.) This energy from the laser passes through the ZPO optics and initially strikes mirror 76, which serves to direct the laser energy through a dichroic beam- splitter 78. This dichroic beamsplitter was chosen such that approximately 50% of the 10.6 μm energy from the laser would pass through it, and be reflected by the parabolic reflector 82. In approximately the center of the dichroic beamsplitter is disposed a thin polymer film 80 coated with carbon black paint. We prefer, but are not limited to, Kapton plastic. The laser energy passing through the dichroic beamsplitter 78 is reflected by the parabolic mirror 82, and focussed on the polymer target 80. The Kapton plastic absorbs the laser energy and emits in the wavelength range from 3.5 μm to 4.2 μm. This radiation is recollimated by the parabolic reflector, then reflects off the dichroic beamsplitter, and subsequently enters, via mirror 39, the MTZ optics. (The mirror 39 is out of the plane of the paper, and corresponds to the gimballed mirror 9 of the Amon and Masson patent application concerned with Command Optics.) The mirror 39 is then adjusted such that the pulses created by a spinning optical wedge of the MTZ cause evenly spaced pulses of light to be received by the MTZ detector.

As will be recalled from the Amon and Masson patent application concerned with Command Optics, a detector 11 is utilized in the MTZ path. By virtue of the spinning wedge, an elongate spot of light is projected onto the detector, with this spot or blob of light moving in a circle about the four sensitive bars of the detector. These bars are each radially disposed, and located at 90° intervals. However, the detector and wedge are not depicted herein.

When this spot of light is centrally located, four equally spaced output pulses of equal height will be received, whereas if the MTZ axis is displaced from the intended line of sight to the target, pulses of variable spacing will be received. The relative pulse spacings indicate the direction of the offset of the MTZ from the ZPO line of sigh t, and dictate the repositioning of the mirror 39. The MTZ may be regarded as boresighted to the ZPO when the output pulses are evenly spaced.

To accomplish a boresighting of the TMLO optics, the mirror 86 (corresponding to mirror 3 of the Amon and Masson "Command Optics" patent application), is switched back such that it directs the energy of the laser onto a mirror 88, that in turn directs this energy onto the dichroic beamsplitter 78. Approximately 50% of this energy is directed onto the parabolic reflector 82, that serves to focus the laser energy onto the polymer target 80 which, as before, emits in the 3.5 μm to 4.2 μm wavelength range. This emission is reflected by the parabolic mirror 82, and enters the MTZ detector as before.

It is often found that the position of the mirror 39 for achieving boresight through the ZPO optics differs from the mirror position for achieving TMLO boresight. In other words, the closed servo loop of the gimballed mirror may provide two entirely different readouts for boresighting the TMLO and ZPO to the MTZ axis.

Although other solutions are possible, our preferred option is to note the discrepancy between the TMLO and MTZ lines of sight, and then compensate for this discrepancy in missile flight by suitable inputs to the system software.

As should now be apparent, we have provided a highly advantageous Boresight Module arrangement and method by which boresighting of an optical system may be rapidly and accurately accomplished, and in a most convenient manner.

We claim:

1. An optical arrangement for use in boresighting a plurality of optical paths utilized in a missile beam guidance system, to a target tracker used therewith, comprising a first mounting means for supporting a plurality of retro-reflective optical assembles in a closely spaced array, and a second mounting means in which is supported an integrated laser system for providing beam guidance to a missile, said second mounting means also supporting at least one optical target tracker, said second mounting means having a first operational mode in which its integrated laser system is successively utilized in conjunction with at least one of said retro-reflective optical assemblies for boresighting said tracker, and having a second operational mode in which a target is acquired and thereafter tracked.

2. The optical arrangement as recited in claim 1 in which said first mounting means, when said second mounting means is being utilized in its first operational mode, has at least one retro-reflective optical assembly that accomplishes a wavelength conversion, such that only a single laser need be incorporated into said second mounting means.

3. The optical arrangement as recited in claim 1 in which one retro-reflective optical assembly of said first mounting means utilizes a component that, when heated by laser energy, changes contrast in a manner that can be sensed by a TV tracker.

4. The optical arrangement as defined in claim 1 wherein one of said retro-reflective optical assemblies utilizes a component that, when heated by laser energy, changes contrast in a manner that can be sensed by optical devices capable of tracking missile flight during the phase in which the motor of a missile is operating.

5. The optical arrangement as defined in claim 1 in which two retro-reflective optical assemblies of said first mounting means utilize components which convert laser energy to shorter infrared and visual wavelengths for the purpose of successively boresighting an infrared and a TV tracker.

6. The optical arrangement as recited in claim 1 in which said first mounting means and said second mounting means are mounted in closely related positions on a turret provided on a vehicle.

7. An optical arrangement for use in boresighting a plurality of optical paths utilized in a missile beam guidance system, to target trackers used therewith, comprising a first mounting means for supporting a plurality of retro-reflective optical assembles in a closely spaced array, and a second mounting means in which is supported an integrated laser system for providing beam guidance to a missile, said second mounting means also supporting at least one optical target tracker, said second mounting means being rotatable, and having a first operational mode in which its integrated laser system is successively utilized in conjunction with said retro-reflective optical assemblies for boresighting said trackers, and having a second operational mode in which a target is acquired and thereafter tracked.

8. The optical arrangement as recited in claim 7 in which said first mounting means, when said second mounting means is being utilized in its first operational mode, has at least one retro-reflective optical assembly that accomplishes a wavelength conversion, such that only a single laser need be incorporated into said second mounting means.

9. The optical arrangement as recited in claim 7 in which one retro-reflective optical assembly of said first mounting means utilizes a component that, when heated by laser energy, changes contrast in a manner such that can be sensed by a TV tracker.

10. The optical arrangement as defined in claim 7 wherein one of said retro-réflective optical assemblies utilizes a component that, when heated by laser energy, changes contrast such that it can be sensed by optical devices capable of tracking missile flight during the phase in which the motor of the missile is operating.

11. The optical arrangement as recited in claim 7 in which said first mounting means and said second mounting means are mounted in closely related positions on a turret provided on a vehicle.

12. An optical arrangement for use in boresighting a plurality of optical paths utilized in a missile beam guidance system, to target trackers used therewith, comprising a first mounting means for supporting a plurality of retro-reflective optical assembles in a closely spaced array, and a second mounting means in which is supported an integrated laser system for providing beam guidance to a missile, said second mounting means also supporting at least one optical target tracker, said second mounting means being rotatable, and having a first operational mode in which its integrated laser system is successively utilized in conjunction with said retro-reflective optical assemblies for boresighting said trackers, and a second operational mode in which a target is acquired and thereafter tracked, said first mounting means having one retro-reflective optical assembly utilized with two separate optical paths, with crossed slits associated with a pair of reticle wheels being utilized in only one of such optical paths.

13. An improved method for boresighting a plurality of optical paths utilized in a missile beam guidance system, to target trackers used therewith, comprising the steps of positioning a plurality of retro-reflective optical assemblies in a closely spaced array, positioning nearby a rotatable mounting means containing an integrated laser system for providing beam guidance to a missile, and also containing at least one optical target tracker, utilizing said integrated laser system in conjunction with said retro-reflective optical assemblies in a boresighting mode, such that said trackers are boresighted, and thereafter rotating said rotatable mounting means in order that said trackers can be utilized in an operational mode in which a target is acquired and tracked.

* * * * *